United States Patent [19]

Lotz

[11] Patent Number: 4,735,399

[45] Date of Patent: Apr. 5, 1988

[54] METHOD OF OPERATING A CONTINUOUS CASTING APPARATUS AND A CASTING FLAME CUTTING MACHINE FOR CARRYING OUT THE METHOD

[75] Inventor: Horst K. Lotz, Wiesbaden-Delkenheim, Fed. Rep. of Germany

[73] Assignee: Aute Gesellschaft fuer autogene Technik mbH, Forch, Fed. Rep. of Germany

[21] Appl. No.: 834,618

[22] Filed: Feb. 28, 1986

[30] Foreign Application Priority Data

Mar. 16, 1985 [EP] European Pat. Off. ..... 85103051

[51] Int. Cl.[4] ..... B23K 7/10

[52] U.S. Cl. ..... 266/50

[58] Field of Search ..... 266/50

[56] References Cited

U.S. PATENT DOCUMENTS 3,614,978 10/1971 Kosco ..... 266/50

4,318,439 3/1982 Hiroshima et al. ..... 266/50

4,475,719 10/1984 Lotz ..... 266/50

*Primary Examiner*—Wayland Stallard

*Attorney, Agent, or Firm*—Gifford, Groh, VanOphem, Sheridan, Sprinkle and Dolgorukov

[57] ABSTRACT

A continuous casting apparatus providing high precision in the weight of workpieces cut from a continuous casting, includes a track disposed parallel to the casting, and a flame cutting machine movably mounted on the track by a machine carriage and a traveller clampable to the continuous casting. A multiple measuring device is provided at or near the cutting machine to detect data relating to the gross physical characteristics of the continuous casting, which is then used to control operation of the appartaus.

34 Claims, 10 Drawing Sheets

METHOD OF OPERATING A CONTINUOUS CASTING APPARATUS AND A CASTING FLAME CUTTING MACHINE FOR CARRYING OUT THE METHOD

BACKGROUND OF THE INVENTION

The invention relates to a method of operating a continuous casting apparatus with a flame cutting machine for cutting off continuous casting portions.

SUMMARY OF THE INVENTION

Operation of a continuous casting apparatus depends on a large number of operating data. In order to produce workpieces of a given weight, the procedure often involves using large and thus uneconomical tolerances as, when determining operating data, the basic starting point taken is theoretical values which however in practice suffer from not inconsiderable variations due to different circumstances such as wear of the mold and mold setting tolerances, the casting temperature, the casting speed, wear at and the setting of support or drive rollers, the conditions of cooling and the like, so that, in order reliably to obtain a workpiece which is of a given weight of material, large safety tolerances are often used, which thus result in an inevitable waste of material.

In comparison therewith, the object of the present invention is that of providing an optimizing casting flame cutting apparatus which more particularly using a flame cutting machine provides for cutting off a workpiece of a desired length which precisely or almost corresponds to a given weight of workpiece.

The invention recognizes the fact that, in order to attain that object, it is necessary to start from the actual operating values of the continuous casting apparatuses, and that said actual operating values can only be ascertained precisely at the moment at which the values to be determined are no longer subjected to any further influence, that is to say, in the region of the flame cutting machine which carries out the cutting operation on the continuous casting in order to produce the workpiece.

Accordingly, the invention provides that, at the flame cutting machine, measuring data such as the width, thickness and cross-sectional shape of the cast component as well as the casting temperature, casting speed, homogeneity over the continuous length of the casting, surface defects of the casting and specific weight of material are detected, and are evaluated in a computing and control means, and the values are made available for optimizational control of the continuous casting apparatus on the one hand for immediate operation and on the other hand for long-term optimization.

In its specific embodiment, the invention proposes that the values obtained are introduced into the flame cutting machine itself for cutting off a workpiece of a desired length which precisely or almost corresponds to a given weight of workpiece.

In a further embodiment the invention provides that, for wastagefree division by the flame cutting machine, a first cast portion which is determined with conventional safety tolerances is measured and cut off, as a calibration workpiece, and that the deviations which are known thereby, in respect of temperature, homogeneity and shape, from a weight/length relationship which takes account of the ideal case, are introduced into the flame cutting machine as a calibration value in a new presetting in respect of the length of cast portion, for cutting off a second cast portion.

In accordance with a development therein, the invention proposes that a second cast portion which is produced on the basis of the calibration value is re-weighed and its weight/length relationship is used as a correction value for determining the length of the third portion, the correction value are obtained from the third portion for the fourth portion, and so forth.

In that procedure, use is advantageously made of measuring means which are disposed in the region of the flame cutting machine, for thickness, width and cross-sectional shape of the cast component, temperature or other weight-determining properties, in order to improve or confirm the measurement result.

The invention likewise provides a casting flame cutting machine for continuous casting apparatuses for carrying out the method. The flame cutting machine is provided with a track which is arranged parallel to the continuous casting and on which the machine is movable by means of a machine carriage and a travelling device for clamping to or on the casting by hydraulic, pneumatic or motorized means, and is distinguished in that provided at the flame cutting machine or in the region thereof is a multiple measuring device for detecting a plurality of measuring data such as width, thickness and cross-sectional shape of the continuous casting as well as casting temperature, casting speed, homogeneity over the continuous length of the casting, surface defects in the casting and specific weight of material.

In that connection, an advantageous embodiment provides that the computing and control means serves for long-term optimization for the entire continuous casting apparatus by the measured values being used for setting the size of the casting mold, the set or configuration of the casting support rollers in the roll stand, the casting speed, the conditions of cooling in order to reduce convex and concave continuous casting shapes, and warning signals in order for example to initiate replacement of the mould or the rolls during a following repair operation, and for correction factors for the flame cutting machine.

Further embodiments of the flame cutting machine are characterized in the subsidiary claims; in particular the further development in the invention that the flame cutting machine or the multiple measuring device has a weighing means associated therewith, and that the weighing means transmits the weighing measurement data for controlling the flame cutting machine.

An embodiment of the invention which is particularly advantageous for that purpose provides that the weighing means comprises two or three or more weighing rollers depending on the length of the continuously cast portion, which are arranged in such a way that they can be raised and lowered on pressure measuring means in the discharge roller bed downstream of the flame cutting machine, and that the weighing means lifts the respective portion of continuous casting which has just been cut off, while stationary or as it passes through, to carry out the weighing operation, on the basis of positional information, for example supplied by a light barrier assembly.

BRIEF DESCRIPTION OF THE DRAWINGS

The invention will now be described in greater detail by means of embodiments with reference to the accompanying drawings in which.

DETAILED DESCRIPTION OF THE PREFERRED EMBODIMENT

Figure 1:
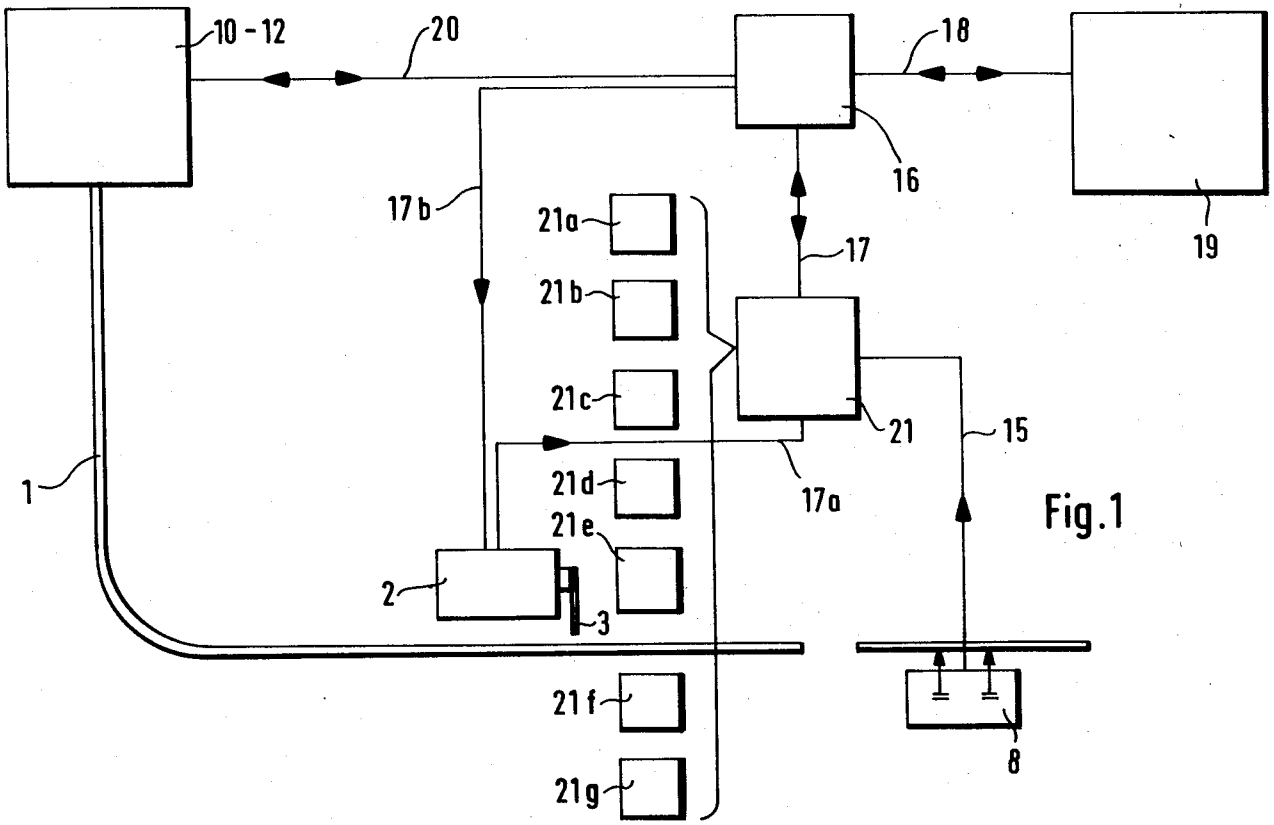
FIG. 1 is a diagrammatic view of the continuous casting apparatus with flame cutting machine and associated multiple measuring device, weighing means and computing and control means.

Referring to FIG. 1, shown therein is a flame cutting machine 2; the term 'flame cutting machine' is intended to denote the entire flame cutting machine installation with the conventional support or foundation structures, rails and other components for travelling movements, delivery or supply means as well as a multiple measuring device with which there are associated a computing and control means 16 and a weighing means 8.

The multiple measuring device 21 goes far beyond the previous arrangements for measuring the length of a cast portion. Rather, it is provided for determining a plurality of measuring data such as the width, thickness and cross-sectional shape of the cast component, as well as casting temperature, casting speed, homogeneity over the continuous length of the cast component, surface defects on the cast component and the specific weight of material. By way of the computing and control means 16 with which a large-size computer 19 can be associated by way of the line 18, the flame cutting machine 2 with its multiple measuring device 21 provides for long-term optimization for the entire continuous casting apparatus 10, 11 and 12 in that, by way of the connecting line 20, the measured values can be used for setting the size of the mold 12, setting or shaping of the continuous casting support rollers in the roll stand, the speed of movement of the casting, the conditions of cooling for the purposes of reducing convex and concave deformations of the continuous casting, and warning signals, in order for example to initiate replacement of the mold 12 or the rolls during a following repair operation, and for corrections at the flame cutting machine 2.

The multiple measuring device 21 has a means 21*e* for measuring the width and thickness of the continuous casting so that in principle by means of the specific weight it is possible to determine the weight of the workpiece to be cut off. In that connection the multiple measuring arrangement 21 and 21*e* is so designed that sensing operations are carried out in regard to the width and thickness of the workpiece at a number of locations, as well as from both sides, that is to say on the right and the left of the continuous casting 1 and above and below, in order to ascertain the precise shape of the workpiece, in particular any concave or convex configuration that may be found thereon.

More particularly, the operation of measuring the width of the continuous casting may be effected by pulse generators which are fixedly connected on burner transverse travel drive means, to the pinion and toothed rack drive, and a pulse counter for determining the spacings of predetermined and reproducible zero points from the two edges of the continuous casting. Installed between the control means for the burner travel movements and the cutting cycles are edge sensing means so that the actual width of the casting 1 can be measured for the purposes of further processing and setting of correction factors or signals.

It is also possible to install pulse generators on the clamping arm system for clamping in a tongs-like fashion to the sides of the continuous casting 1, and to provide a pulse counter, wherein the spacings of the predetermined and reproducible, completely open zero positions, relative to the clamped sides of the casting 1, are measured by contact, so that the actual width of the casting 1 can be passed on for further processing in order to set correction factors or signals.

Another possibility provides installing pulse generators with pulse counters on two sensing rod systems which are specifically installed for that purpose and which at suitable opportunities are moved from given and reproducible zero starting positions until they come into contact with the sides of the continuous casting 1, and thus give the actual width of the casting 1 for further processing in order to set correction factors and signals.

The continuous casting thickness measuring means 21*e* with which the multiple measuring device 21 of the flame cutting machine 2 is provided comprises either a pulse counter and a pulse generator meshing with a pinion in a toothed rack, which moves downwardly from a predetermined and reproducible zero position with the parts of the machine for setting against the continuous casting 1 for the purposes of synchronization in relation to the continuous casting 1 and the flame cutting machine 2 until contact occurs, when being set against the continuous casting 1, and thus determines the actual thickness of the continuous casting 1 which is supported on a roller bed or table or the like which is at a given level, like also the flame cutting machine 2 which moves on rails at a given level, for further processing in order to set correction values or signals, in which respect signals are given for further processing in order to set correction factors; or the arrangement has a pulse counter and pulse generator which is moved by a downwardly swinging clamping arm driven by compressed air, for frictional synchronization of the flame cutting machine 2 with the upper surface of the continuous casting 1, whereby the actual thickness of the continuous casting is supplied for the purposes of further processing and in order to set correction factors and/or signals.

It is also possible to arrange a pulse counter and a pulse generator on a special height sensing rod which at a suitable opportunity moves from a predetermined and reproducible zero position until the surface of the continuous casting 1 is contacted. That therefore gives the actual thickness of the continuous casting 1, for further processing and for the purposes of setting correction factors and/or signals.

The arrangement may also comprise a pulse counter with pulse generator on the burner height adjusting sensors, with predetermined and reproducible zero positions, for downward movement of the burners or torches to give the appropriate spacings of the nozzles after the operation of sensing the precise surface of the continuous casting 1. In that way, the actual thickness of the continuous casting is determined for further processing in order to set correction factors and signals. A pulse counter and a pulse generator may also be disposed on a lever or carriage in a carriage guide means at or in the region of the flame cutting machine 2. A measuring roller 7 moves downwardly from a given and reproducible zero position, for the purposes of measurement of length, or another sensor is lowered on to the surface of the continuous casting 1, thereby ascertaining the actual thickness of the casting 1, for further processing and for the purposes of producing correction factors and/or signals.

In particular for the purposes of measuring thickness the arrangement may comprise two or more thickness measuring means 21*e* which operate from below in an upward direction against the underneath surface of the continuous casting 1. That arrangement uses devices which are already present or its own particular drive means and sensing mechanisms with pulse generators in order even more precisely to be able to produce the thickness measurement results, by virtue of forming the difference relative to the surface-measuring pulse measuring means and the counting device.

Thus it is in principle advantageous to provide two or more independent sensing and pulse generator devices, as already described above, in order to measure the thickness of the middle of the upper and lower surfaces respectively and also further thicknesses which are disposed at a given suitable spacing therefrom, in order to detect and measure convex and concave cast configurations. In that way the cross-section of the continuous casting 1 can be detected with a very high degree of accuracy, in order to produce suitable correction factors and signals, for example for the length measuring means or the continuous casting speed measuring means 21*f*. In that connection, temperature and cooling steps may also play a part, the signals being used for the purposes of controlling same. In order more particularly to be able to ascertain the temperatures involved and to make use of corresponding signals, the multiple measuring device 21 also includes a temperature measuring means 21*d*. It comprises for example a thermometer which is installed within or on components which contact the continuous casting 1 in order to produce the synchronous movement. Reference may be made in this respect to wear plates on the clamping arms or contact skids, from which temperature measurements may be taken at given times, that is to say in particular for the purposes of correction shortly prior to determining the length of the next workpiece. For that purpose, corresponding signals are fed into the length measuring means 21*f*.

The above-mentioned multiple measuring device 21 also includes means 21*f* for measuring the speed of the continuous casting. The speed measuring means 21*f* are provided with a pulse rate counter in order to detect the number of pulses which come from the usual length measuring means 21*f* which is driven by friction by the continuous casting 1, by way of a measuring wheel, and which rotates a pulse generator. Within a predetermined period of time, for example 1 minute, the pulses are counted and the actual speed of the continuous casting 1 is measured in the vicinity of the flame cutting machine 2 in order to process that speed in comparison with empirically established correction factors or speed relationships, and to transmit improved correction factors into the length measuring means 21*f* or to other locations of the continuous casting apparatus.

As described, the multiple measuring device 21 comprises a plurality of measuring means 21*a* through 21*g* of which the most important have been described above, that is to say, if the need for determining specific data occurs, the multiple measuring device 21 can be correspondingly enlarged. Associated with the multiple measuring device 21 is a computing and control means 16 which processes the measurement values obtained and provides suitable signals not only for operation of the flame cutting machine 2 but also for the entire continuous casting installation 10, 11 and 12. For that purpose, there are provided suitable connections 17, 18 and 20 and circuits so that for example by reference to the signals obtained and delivered, the size of the casting mold 12 can be set or the shaping position or setting of the casting support or transportation rolls in the roll stand of the casting installation can be adjusted. The speed of casting and, as already mentioned above, the conditions in respect of cooling in order to reduce convex or concave configurations of the continuous casting may be adjusted on the basis of the signals obtained. The computing and control means 16 of the flame cutting machine 2 may also supply warning signals in order possibly to indicate the need for replacement of the mold 12 and the rolls in a future repair operation.

Also provided at the flame cutting machine is a marking means 21*a* for the purposes of stamping or marking or in some other way applying signals in the form of letters and/or figures, to the top sides or front surfaces of the casting 1. The marking operation is effected with the movement of the flame cutting machine 2 in the cutting operation during synchronous movement or with a device 21*a* which is disposed in a stationary position at the flame cutting machine 2 and which may also be disposed directly in the vicinity thereof. In that way the portions of casting which are to be formed in the future are marked while the continuous casting 1 is moving past the apparatus at the casting speed, or by means of a device 21*a* which is disposed at the flame cutting machine 2, the portion of continuous casting to be formed in the future moving past at a speed which results from the casting speed and the flame cutting speed, while the flame cutting machine 2 is stationary or is moving back into the initial or starting machine. The continuous casting speed pulse generator or counter serves for calculating the necessary relative speed which corresponds to the marking speed.

It is also possible to operate with a combined marking means 21*a* which uses the systems referred to above, in order to mark the future continuous casting workpiece or the continuous casting workpiece which is to be cut off in the near future, at any time within the casting-flame cutting cycles.

All the above-mentioned data which are applied to the continuous casting 1 by using a marking made up of one, two or more lines, serve to control operation of the continuous casting installation 10, 11 and 12 and the flame cutting machine 2, by using data or corresponding signals which relate to the composition of material, basic cutting temperature of the material, basic cross-section and workpiece shape, originally required workpiece length and so forth. Thus it is possible, by including more items of information, for example the measurement in respect of weight of the portion of continuous casting, to determine the definitive cold length, or to regulate a static system for the final result of long-term optimization.

Finally, a scale removing means 21*b* also serves for regular operation of a flame cutting machine 2 having the above-described means. It provides for satisfactory marking, better defect recognition and also improved measurement. It preferably comprises a high-capacity heating burner or torch for melting and blowing away the scale in front of and in the region of the marking, preferably on the side surfaces. Removal of the scale ensures a clean and reliable marking result which gives the information required at least until the continuous casting portion passes into the reheating furnaces. However it is also important for scale to be removed in the region of measuring probes or measuring sensors in order to ensure precise measurements in respect of temperature, thickness, width or shape.

In the further embodiment, the scale removing means 21*b* may be provided with a flaming burner or torch in order to clean parts of the outer side or top surfaces in order to find defects and to effect a selective defect elimination operation by a flaming process. That procedure provides simultaneously for feeding into the computing and control means 16 the weight of the material to be removed, which is achieved by measuring and calculating the length, width and depth fo flaming tracks or paths, in order to produce a correction factor in respect of the length of the workpiece, for optimization purposes. The return speed of the flame cutting machine 2 is predetermined in order in conjunction with the continuous casting speed to determine a relative speed which corresponds to the flaming speed.

A defect finding means 21*c* which is also arranged at the flame cutting machine 2 serves for 'in-line' examination or checking of hot, warm and cold casting surfaces by means of optical, induction heat or eddy current devices. The arrangement operates at the casting speed, the flame machine travel speed or suitable relative speeds.

The defect finding means 21*c* produces correction factors which, in relation to the defect size, influence measurement in respect of the workpiece length.

Provided in the above-described manner is an optimizing continuous casting flame cutting machine 2 which with its component devices makes it possible to operate a continuous casting apparatus 10, 11 and 12 under optimum operational conditions. In particular the necessary tolerances when cutting up workpieces are substantially reduced, with the result that the production or capacity of the continuous casting installation is optimized. It is possible to carry out the operation of cutting off a workpiece at a desired length, in such a way that it precisely or almost corresponds to a given weight of workpiece. A continuous casting portion identification, which cannot be the subject of confusion, permits quality control and quality improvement in particular in relation to the energy-saving use of hot cast portions in pusher or tunnel or continuous furnaces, which is a procedure to be recommended.

The flame cutting machine 2 together with conventional portion measuring means for indicating the beginning of the cutting operation is the first device which serves not to produce a continuous casting but to produce casting portions. With a number of movements, partly independently of the movement of the continuous casting and in particular with the means 21*e* for measuring the thickness and the width of the continuous casting, as well as further means in the multiple measuring arrangement 21 which forms part of the flame cutting machine 2, the arrangements described make it possible in particular to provide for optimized preselection in respect of length of cut workpieces, with precise marking of data for the purposes of workpiece identification and further processing.

Figure 2:
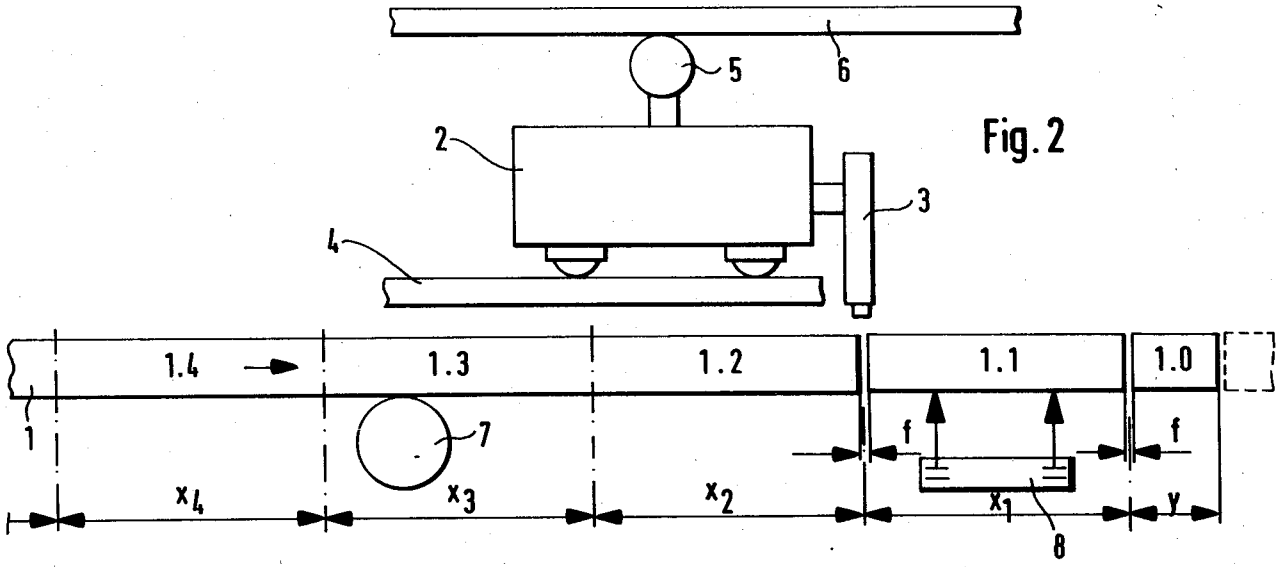
FIG. 2 is a diagrammatic view of the weighing, measuring and cutting system which forms the basis of the present invention.

FIG. 2 shows a continuous casting 1 from which the cropping or joining portion 1.0 is cut off, as well as a first continuous casting portion or calibration portion 1.1 which is provided with conventional safety factors or tolerances. Also illustrated are a second portion 1.2 which is to be cut off, a third portion 1.3 and a fourth portion 1.4. Said portions are cut off by a continuous casting flame cutting machine 2 which is provided with a cutting burner or torch 3. The flame cutting machine 2 with the cutting burner or torch 3 is movable along the continuous casting 1 on a flame cutting machine track 4. With the flame cutting machine 2, a measuring wheel 5 moves along a correspondingly arranged toothed rack 6. A stationary measuring roller 7 is also disposed beneath the casting 1. Also disposed beneath the discharge roller bed or table is a diagrammatically illustrated weighing means 8 which will be described in greater detail hereinafter.

The portions 1.1 through 1.4 which are to be cut off must have a certain amount of material in order in the subsequent working operations for example to ensure that they provide rolled portions of given dimensions. Excessively small amounts of material result in reject portions so that considerable safety factors or tolerances are provided in a practical situation.

In that connection, it cannot be assumed in a practical situation that the continuous casting 1 does not suffer from any variations. Thus for example the casting molds 12 suffer from wear and the geometry of the installations also undergoes mechanical changes due to the influences of temperature. Damage to the rolls, the continuous casting guide setting and the narrow side setting at the mold 12 also result in changes in cross-section. Besides those influences of many different kinds, which are due to the equipment used, in particular also influences arising out of the casting procedure are of major significance. Thus, alterations in the continuous casting 1 occur due to a change in ladle, a change in tundish, the use of casting powder, to mention only a few factors involved. In particular however the casting speed and the casting temperature or the nature of the cooling operation also play a major part. It is precisely the latter factor that is responsible for the configuration of the continuous casting 1, that is to say, its shape in three-dimensional terms. Convex or concave side surfaces may also occur and, besides varying homogeneity, subsequent shrinkage must also be taken into consideration. The above-indicated large number of possible influences on the length of a portion of continuous casting 1 which is to be cut off results in practice in the need for considerable safety tolerances or factors, as it is necessary to take account of the possibility of all parameters, in the extreme case, being added together or being subtracted from each other. In practice that results in losses or wastage which can be up to 10%. The benefit which on the other hand can be achieved in avoiding the use of the above-mentioned unnecessary safety factors or tolerances, in conjunction with residual length optimization, is obvious. Nonetheless, hitherto that problem has not been solved in a satisfactory manner as in the case of all steps considered there was an excessive risk of cutting off a portion with an inadequate amount of material which, as it cannot be used, then results in excessive wastage.

Figure 3:
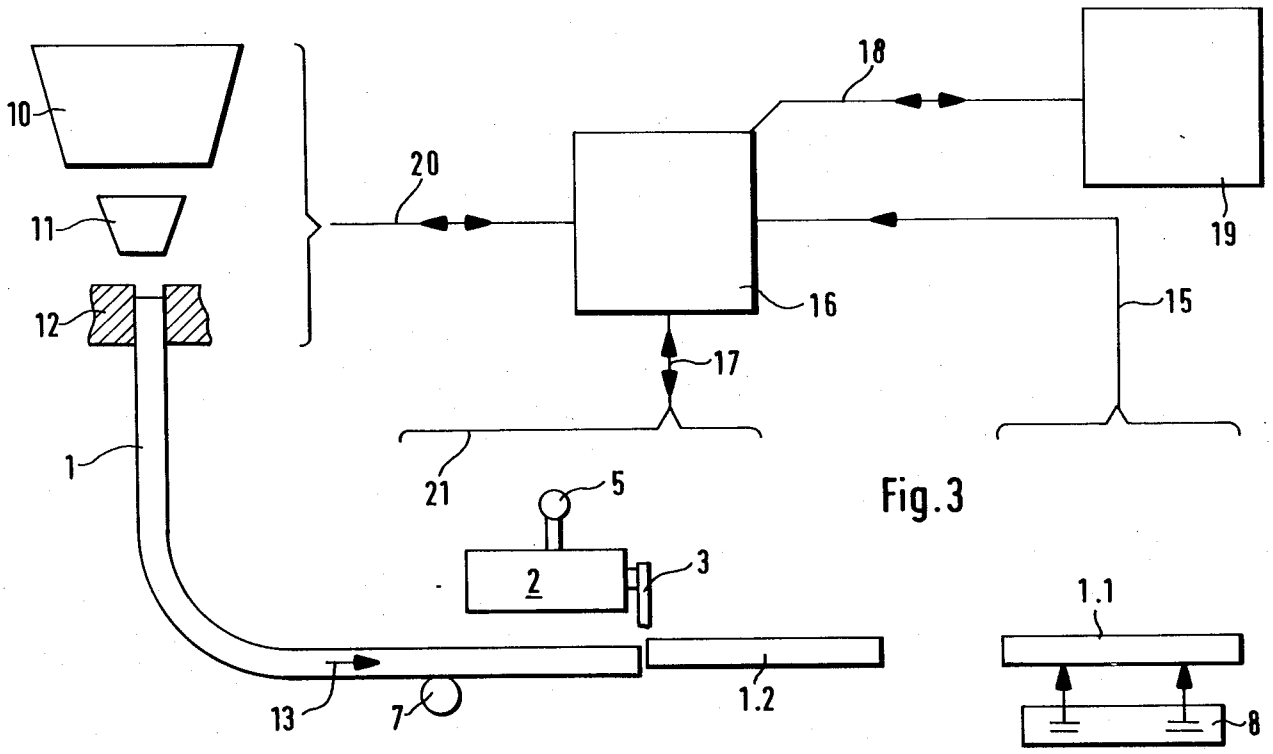
FIG. 3 is a diagrammatic view of the mode of operation of the computing and control means.

FIG. 3 diagrammatically illustrates the computing and control means 16 which, in conjunction with the weighing means 8, makes it possible to cut off continuous casting portions 1.2 through 1.4 which precisely or almost precisely correspond to the desired requirements. The basic starting point taken for the present invention is that irrespective of the configuration of the continuous casting 1 and the homogeneity thereof, the desired amount of material, for further processing, can be determined by a weighing operation.

As shown in FIG. 3, the continuous casting 1 is cast from a casting ladle 10 by way of a distributor channel or passage 11 by means of the mold 12; the continuous casting 1 moves in the direction indicated by the arrow 13 into the region of the flame cutting machine 2, with the measuring roller 7. The continuous casting 1 which, as discussed above, may be of a different configuration which varies during the casting operation and which in addition, besides a variation in homogeneity, is also subjected to shrinkage, may be accurately cut off, taking account of a width f of the cut, into cut portions which comply with the requirements for the subsequent processing operations, only when the amount of material in the portion which is cut off reaches a given value. The amount of material in a continuous casting portion 1.1 through 1.4, which corresponds to a given length $x_1$ through $x_4$, can be ascertained by means of the weighing device 8, by virtue of the weight of the corresponding portion of the continuous casting 1. For that purpose, after the operation of cutting off a cropping or joining portion 1.0 of a length y, a calibration portion 1.1 is cut off with the conventional safety factors or tolerances, and weighed by the weighing means 8. The resulting value is passed by way of a transmission line 15 to a process computer 16 for controlling the flame cutting machine 2. By way of the transmission line 17, the process computer 16 further receives the measurement values from the measuring wheel 5 of the flame cutting machine 2 and from the stationary measuring roller 7, and thus controls the cut or the length $x_2$ for the second portion 1.2, on the basis of the previously cut-off calibration portion 1.1. After the second portion 1.2 has been cut off, being of a length $x_2$, it is also weighed by the weighing means 8 and the measurement value is again passed to the process computer 16 by way of the transmission line 15. The process computer 16, if appropriate, ascertains a correction value for the following third portion 1.3 so that in that case also an optimized length $x_3$ is cut off by the flame cutting machine 2. The next following fourth portion 1.4 is also optimized in the same manner, on the basis of the weight of the portion 1.3, and the corresponding length $x_4$ is ascertained, which is to be taken into account when cutting off that portion 1.4 by means of the flame cutting machine 2. The process computer 16 is connected by way of a transmission line 18 to a large-scale installation computer. That permits optimization control of the entire continuous casting apparatus, besides controlling operation of the flame cutting machine 2 for cutting off the portions 1.1 through 1.4, in that control and monitoring data can be supplied to the casting apparatus by way of the transmission line 20, just as conversely measuring data can be supplied by the casting apparatus 10, 11 and 12 by way of the transmission line 20 to the process computer 16 and the installation computer 19. Thus, besides the control for immediate operation, the arrangement can also permit long-term optimization of the continuous casting apparatus.

The entire casting operation can be governed in optimum manner in that a multiple measuring device 21 which is only shown in diagrammatic form, in the flame cutting machine 2, detects data in respect of the continuous casting thickness, width, cross-sectional shape, temperature and other properties which determine crosssection, by per se known means such as sensing devices, with the detected data values being passed on to the process computer 16.

Figure 4:
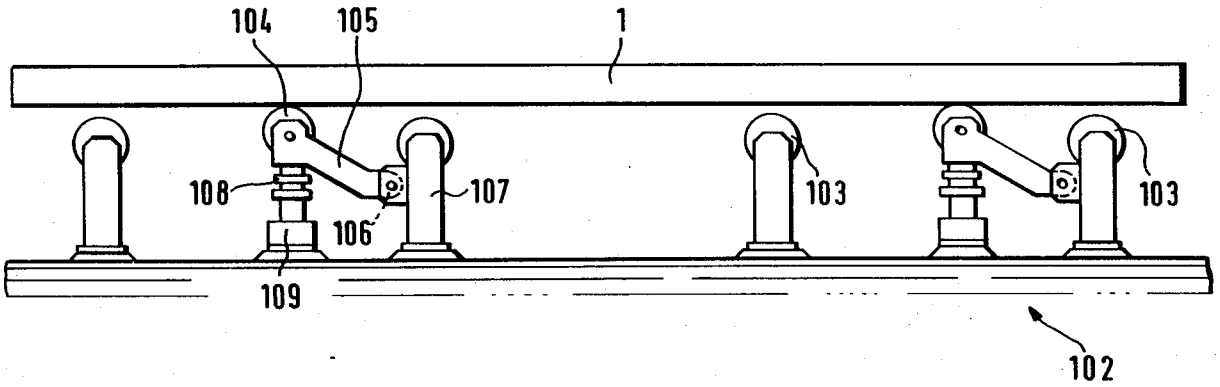
FIG. 4 shows a weighing means.

FIG. 4 shows a workpiece 101 which has been cut from a continuous casting by means of a flame cutting machine (not shown). The workpiece 101 is disposed over a weighing device 102 which is arranged below the workpiece 101. Disposed beside the roller bed rollers 103 are weighing rollers 104 which by way of pivot levers 105 are supported in a pivot mounting 106 which is stationary and which is preferably disposed on the support 107 for the roller bed rollers 103. The weighing rollers 104 are supported at their pivotal levers 105 by force or weight measuring devices which consist of pressure cells or measuring capsules 108 which act on pressure cylinders 109. The weighing rollers 104 can be raised and lowered so that in the raised condition the workpiece 101 is no longer supported by the rollers 103 but rests solely on the weighing rollers 104 so that a weighing operation in regard to the workpiece 101 can be performed by way of the pressure measuring cells 108. The weighing operation is initiated when the workpiece 101 has reached a given position which is determined for example by a light barrier assembly. The weighing operation can be carried out with the workpiece 101 stationary or passing through the arrangement; in the latter case, additional damping means (not shown) may be provided, for damping the movement of the workpiece 101. The pressure measuring results with the weight of the workpiece 101 and also without the weight of the workpiece 101, that is to say, the weight of the weighing means 102 itself, are transmitted to a length measuring and control means of the flame cutting machine 2. Starting from a net weight in respect of the measured workpiece 101, in regard to each following workpiece which is to be cut from the continuous casting, a new length of casting portion is calculated on the basis of the preset value in respect of the weight of the workpiece 101, and that is used as a preselection value in respect of the length of the piece to be cut off, for the purposes of controlling the flame cutting machine 2. In that way the flame cutting machine 2 with associated weighing means permits optimization of the continuous casting, in regard to the residual end portion, in relation to the content of the casting ladles 10 and the distributor passage or channel 11. In addition wastage due to inaccurate workpiece lengths is minimized while in regard to sequential casting operations, it is possible to provide for adjustment to a very wide range of varying operating parameters by the flame cutting machine 2 cutting off workpieces 101 which precisely or almost correspond to a given weight of workpiece.

Figure 5:
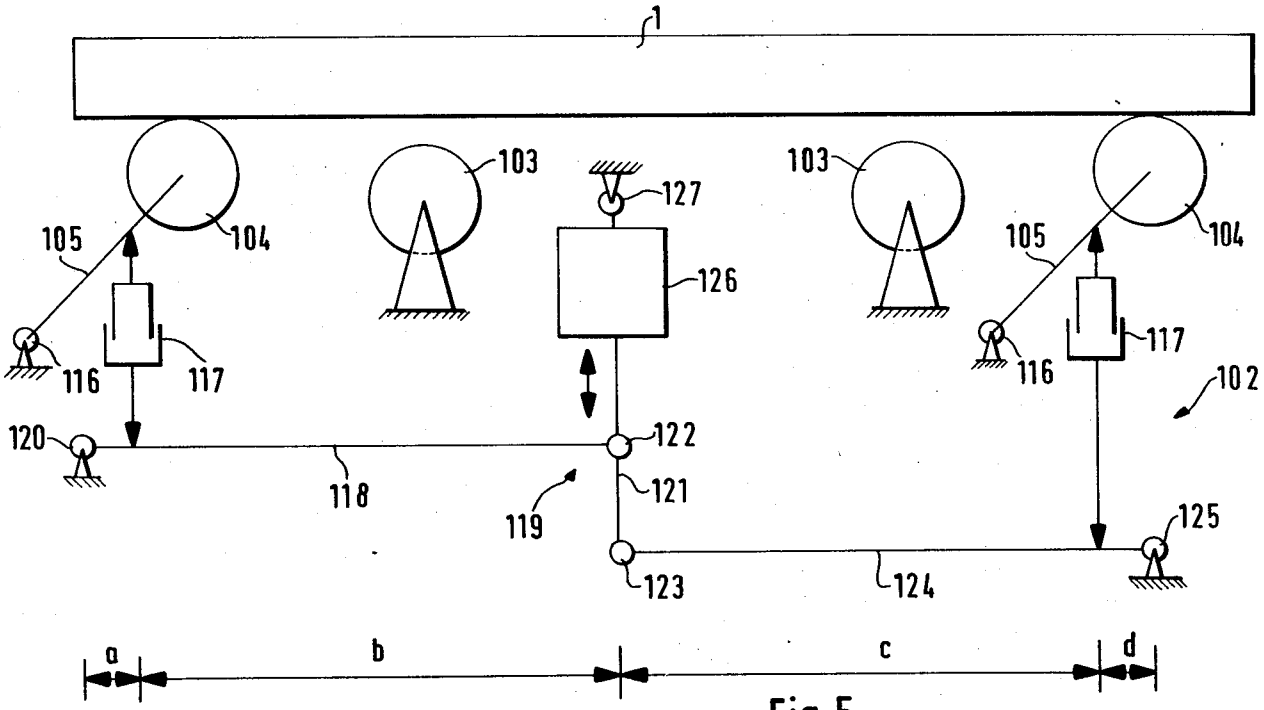
FIG. 5 shows another embodiment of a weighing means with co-operating measuring arms.

FIG. 5 shows the modified embodiment of a measuring device in which once again the workpiece 101 rests on weighing rollers 104 which are arranged between the rollers 103 of the roller table. The weighing rollers 104 may also be in the form of arms or bars. The weighing rollers 104 are secured to weighing levers 105 which are pivotally supported in weighing lever mountings 116. A single-acting piston cylinder assembly 117 engages the weighing lever 105 and bears against the measuring arm 118 of a force or weight measuring arrangement 119. The measuring arm 118 is supported at a measuring arm mounting 120 and at its oppositely disposed end is connected to a pull rod 121, at the location indicated at 122. A further measuring arm 124 engages the rod 121 at the location indicated at 123; the arm 124 is supported in a measuring arm mounting 125 and a single-acting piston cylinder assembly 117 is supported thereon in the same manner.

The rod 121 engages a central weighing apparatus 126 which is supported on a weighing machine suspension mounting 127. It is important in regard to the force or weight measuring device that the ratio between the measuring arm portions is the same, in other words, a:b=d:c. For good measuring accuracy, it is necessary for the measuring arrangement to be as light as possible and for the measuring elements to perform a precise gross weighing operation (weight of workpiece+weight of weighing arrangement) and an accurate taring weighing operation (just the weight of the weighing arrangement) in order to arrive at a precise net weight.

From the weighing arrangement, that is to say from the central weighing machine 126, the weighing measurement data are transmitted to the control means of the flame cutting machine 2, although that is not shown in detail here.

For shorter workpieces or for workpieces which can be precisely centrally introduced, the weighing arrangement, as shown in FIG. 5, may operate with at least two co-operating weighing devices consisting of weighing roller 104, weighing lever 105 and support means 117. For very long workpieces, two or more weighing devices 104, 105, 107 are provided; those advantageously co-operate, which are not disposed in mutually juxtaposed relationship. That arrangement then has more weighing rollers 104 than those shown in FIG. 5. The corresponding measuring arms must then also be connected to the pull rod 121 of the central weighing apparatus 126.

The force or weight measuring device may also comprise a per se known driven gyro device in a cardan-type suspension arrangement, for converting a perpendicular force=weighing lever support force, into a rotary movement.

Figure 6:
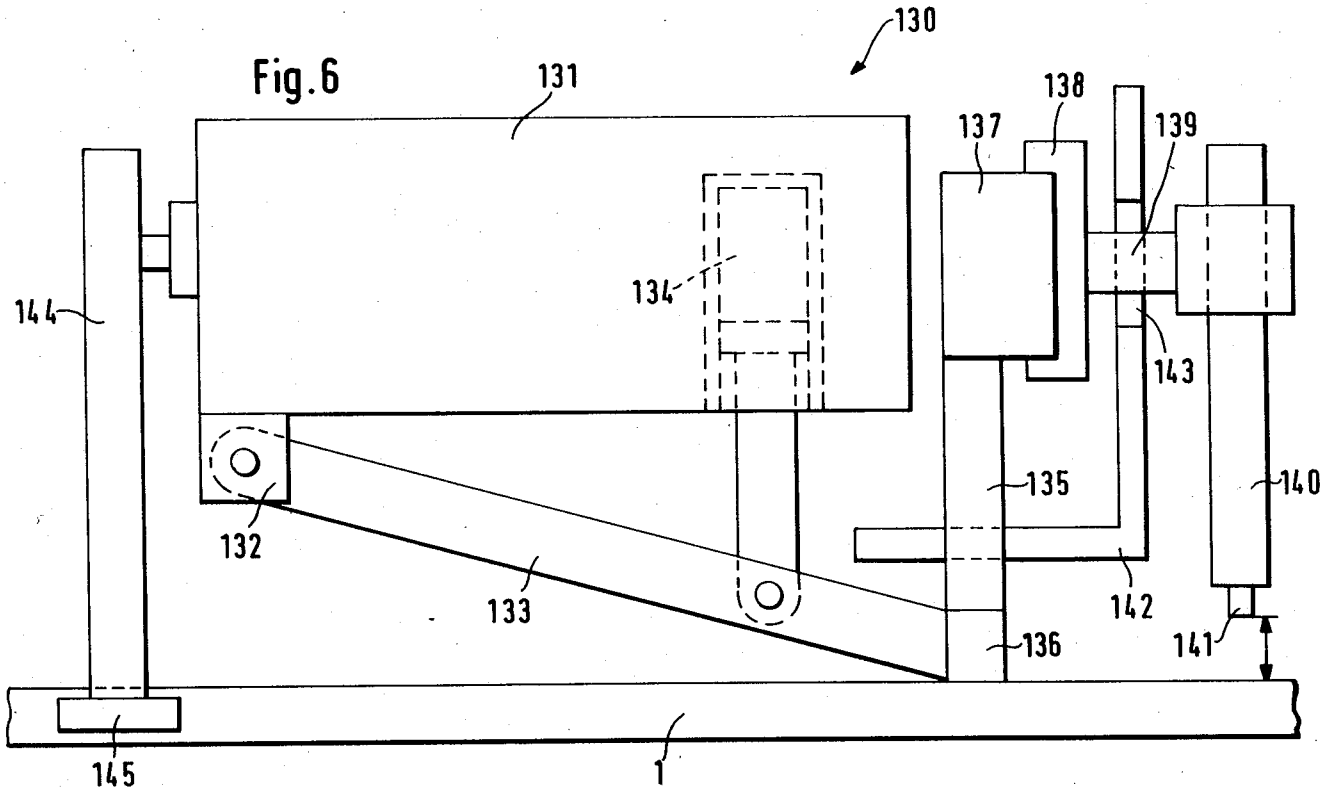
FIG. 6 is a side view of a flame cutting machine.

FIG. 6 shows a flame cutting machine 130 which is disposed above the continuous casting or workpiece 101. Mounted on the body 131 of the machine at the rearward end in a mounting 132 is a synchronization lever 133 which can be raised or lowered by a pneumatic cylinder unit 134 on the machine body 131. At the front end of the synchronization lever 133, in front of the machine body the lever 133 carries a plate 135 with a skid or pressure member 136. The flame cutting machine 130 is applied to the workpiece 101 by means of the skid or pressure member 136, thereby producing synchronized movement. Reference numeral 137 denotes a torch or burner track on which the torch or burner carriage 138 is carried. The carriage 138 carries a torch or burner cantilever arm 139 which carries the torch or burner 140 with the nozzle 141 at its lower end. The carriage 138 with the torch or burner 140 is movable on the track 137 transversely with respect to the continuous casting 1 by means of a water-cooled motor in order thereby to cut off a workpiece 101 from the continuous casting 1. Below the track 132, a thermal protection plate 142 which extends to a position below the body 131 of the machine 130 and through which flows water is fixed to the plate 135. The protection plate 142 has a slot 143 through which the cantilever arm 139 sticks out. Secured to the back of the body 131 of the machine 130 is a measuring roller lever 144 which at its lower end carries a measuring roller 145 which runs along the side of the continuous casting 1.

Figure 7:
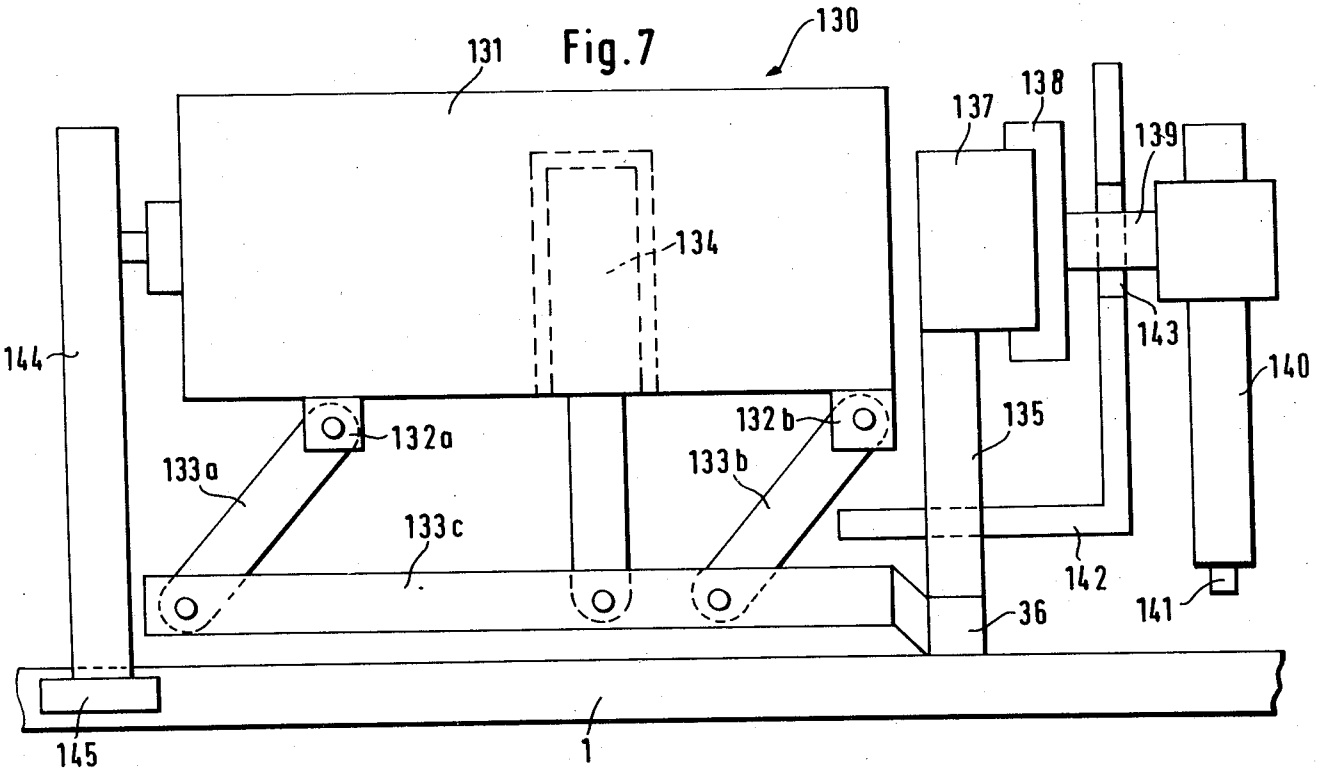
FIG. 7 is a sideview of a flame cutting machine corresponding to that shown in FIG. 3, but illustrating a modified embodiment.

FIG. 7 shows a flame cutting machine 130 with a modified lever system for producing the synchronized movement of the flame cutting machine 130 with the continuous casting 1. The flame cutting machine 130 corresponds in principle to that described with reference to FIG. 6, and in that respect the reference numerals relate to the same components. However, a parallelogram lever system is suspended from the body 131 of the machine 130, being supported at mountings **132*a* and 132*b*. A lever 133*a* is pivotally connected to the mounting 132*a* and a lever 133*b* is connected to the mounting 132*b*. At the end which is remote from the machine body 131, the levers 133*a* and 133*b* carry a main link 133*c* which extends parallel to the machine body 131 and which is raised and lowered by the pneumatic cylinder unit 134. At its forward end, the main link 133*c* carries the plate 135 with skid or pressure member 136 which is applied to the continuous casting 1** to produce synchronous movement.

Figure 8:
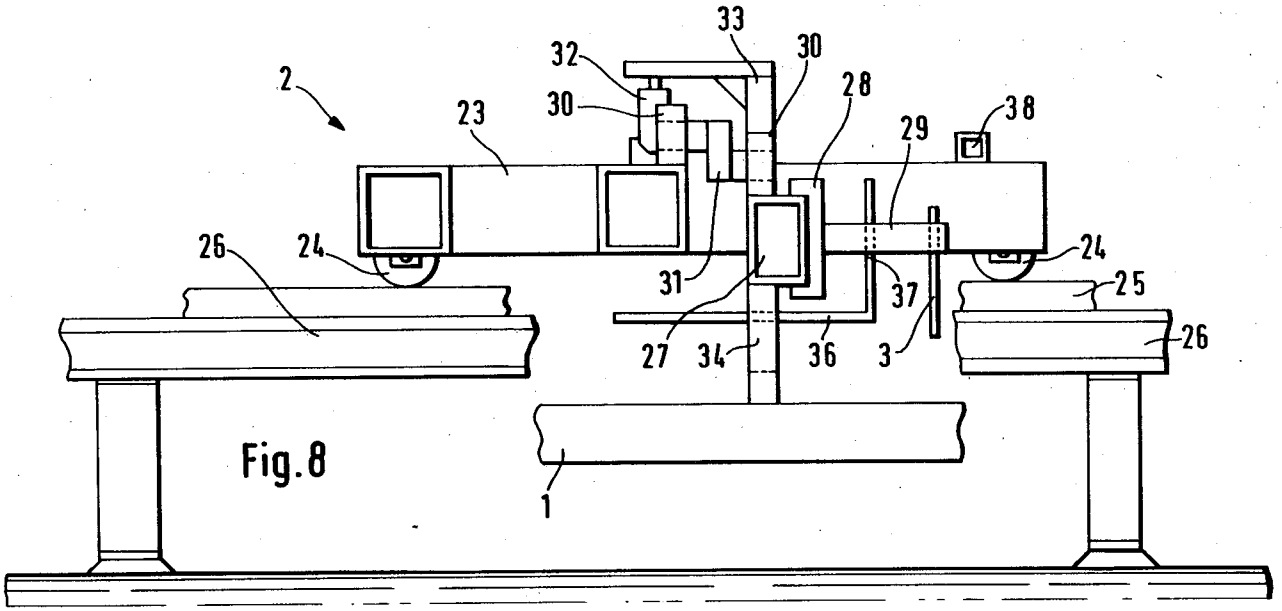
FIG. 8 is a side view of another embodiment of the flame cutting machine according to the invention.
Figure 9:
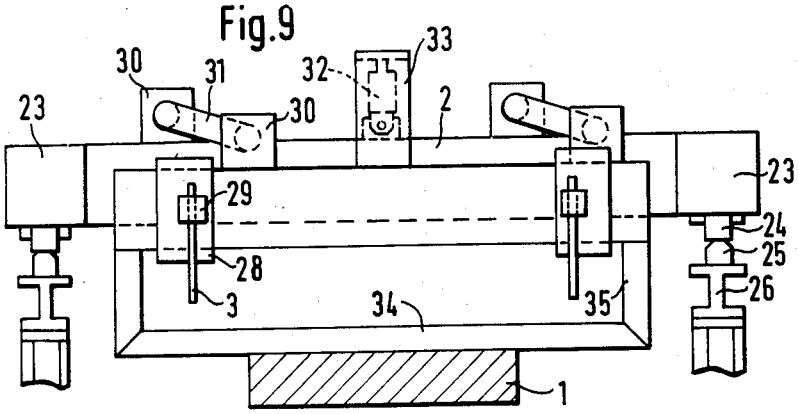
FIG. 9 is a front view of the flame cutting machine shown in FIG. 8.
Figure 10:
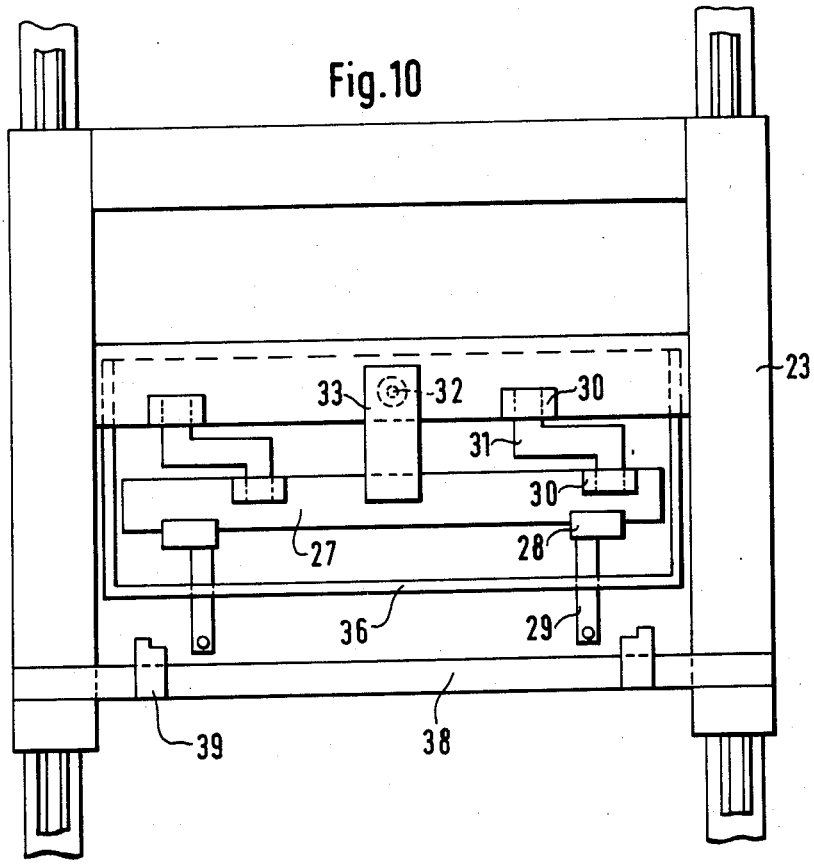
FIG. 10 is a plan view of the flame cutting machine shown in FIGS. 8 and 9.

FIGS. 8 through 10 show a flame cutting machine 2 above the continuous casting 1. The flame cutting machine 2 comprises a machine frame 23 with runners or rollers 24. The rollers 24 run on the track 25 which is supported on a support foundation 26. The machine frame 23 carries a torch or burner track 27 with a carriage 28 to which the cutting torch or burner 3 is secured by way of a torch or burner arm 29. Fixed in mountings 30 are lowering swing arms 31 which permit a lifting and lowering cylinder unit 32 to lower the track 27, by way of a lift-lower arm 33 thereon, until the contact skid or pressure member 34 which is fixed to a support frame 35 comes to bear against the continuous casting 1. Disposed below the track 27 is a thermal protection plate 36 through which flows water and which is of an angular configuration and which protects the flame cutting machine 2 from the effect of radiant heat from above and from the front. Provided in the front part of the protection plate 36 is a slot 37 through which extend burner carrier arms 29 carrying the burner 3. Disposed in front of the burners 3 is a supply pipe 38 for granulation or spray water. The supply pipe 38 is formed from square or rectangular pipes and carries burner alignment stops 39 for precise alignment of the burners or torches 3 relative to each other in order to produce cuts which are precisely aligned in one plane, on the continuous casting 1.

The machine frame 23 is welded up from hollow members and has water flowing therethrough for cooling purposes. The machine frame 23 consisting of transverse and longitudinal members is a construction that is resistant to twisting or warping, and thus also ensures precise guidance for the torches or burners 3 and thus guarantees a precise cut on the continuous casting 1.

Figure 11:
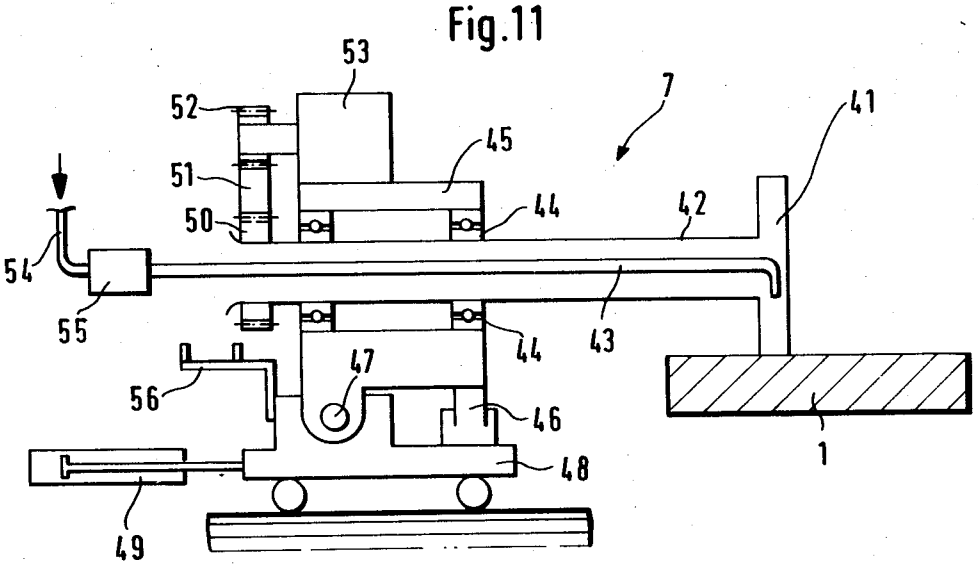
FIG. 11 is a partly sectional view of a measuring roller on an enlarged scale.

FIG. 11 shows a measuring roller 7 which runs with its measuring wheel 41 on the continuous casting 1. The wheel 41 is carried at the end of a hollow measuring shaft 42 through which extends a centrally disposed cooling water pipe 43 which also rotates therewith. The hollow shaft 42 is mounted in the measuring roller housing 45 by means of shaft mountings 44. The shaft housing 45 can be tilted about a tilting mounting 47 by a stroke or linear-action piston 46. The shaft housing 45 with the piston 46 and the mounting 47 is mounted on a displacement carriage 48 which is displaceable at a right angle to the movement of the continuous casting 1 by means of a displacement drive 49 so that the wheel 41 can be displaced transversely with respect to the axis of the continuous casting 1, for double or triple castings. At the end of the hollow shaft 42 that is remote from the wheel 41, the shaft 42 carries a drive wheel 50 which is connected by way of a drive chain or a toothed belt 51 to a drive wheel 52 which is connected to a pulse generator 53. A water supply pipe 54 goes to a rotary water connection 55 by which the cooling water pipe 43 in the hollow shaft 42 is fed with water. Reference numeral 56 denotes a water channel which is mounted to the carriage 48. The stationary measuring roller 7 may also be of such a design that it is not displaceable or it may be mounted in a non-stationary fashion on the flame cutting machine 2. In that case the arrangement may include an upper tilting mounting, with the measuring wheel 41 running on the continuous casting 1 while hanging down from the mounting, which arrangement is not illustrated herein.

The method described, with the above-discussed flame cutting machine for carrying out the method, not only permits optimization in regard to the residual end portion of the continuous casting 1, in relation to the content of casting ladles 10 and the distributor passage 11, but it also minimizes wastage due to inaccurate continuous casting lengths and, in regard to sequential casting operations, permits adjustment to a very wide range of varying operating parameters so that in that way the entire casting operation can be completely controlled.

I claim:

1. A continuous casting apparatus comprising: means for forming a continuous casting; a flame cutting machine for cutting off portions of said continuous casting; means for measuring data such as at least one of the width, the thickness and the cross-sectional shape of the casting, the casting temperature, the longitudinal speed of the casting, the homogeneity over the continuous length of the casting, surface defects of the casting, and the specific weight of the casting material; and computing and control means for evaluating said data for optimizing immediate and long term operation of said apparatus; said apparatus further comprising a track disposed parallel to said continuous casting, on which said machine is movable by means of a machine carriage and a travelling device for clamping said cutting machine to or on the casting by hydraulic, pneumatic or motorized means; wherein in the region of or at the flame cutting machine there is provided a multiple measuring device for detecting said data.

2. A continuous casting apparatus according to claim 1, wherein said computing and control means serve for long term optimization of the operation of the apparatus by employing said measured data for setting the size of the casting mold, the configuration of a plurality of casting support rollers in a roll stand, said longitudinal casting speed, conditions of cooling, warning signals, and correction factors for the flame cutting machine.

3. A cutting apparatus according to claim 1, wherein said multiple measuring device includes marking means permitting either single or multiple line marking so as to provide each casting portion with an identification number and with information regarding the quality, composition, measured data values and correction factors, for optimization of operation of the apparatus.

4. A cutting apparatus according to claim 1, wherein said multiple measuring device includes a scale removing means for removing scale in at least one of the regions of the marking and the regions of measuring probes or measuring sensors.

5. A continuous cutting apparatus according to claim 1, wherein said multiple measuring device comprises a defect finding means which carries out in-line checking of the hot, warm and cold surfaces of the continuous casting by optical, induction heat or eddy current means.

6. A continuous cutting apparatus according to claim 1, wherein said multiple measurable device comprises a temperature measuring means for carrying out measurements at a cut end of the continuous casting in order to determine the temperature of a fresh cast portion.

7. A continuous cutting apparatus according to claim 1, wherein said multiple measuring device comprises a measuring means for measuring the width and thickness of the continuous casting, which detects the width and thickness of a workpiece in either a convex or concave form, and sensing means disposed at a plurality of locations on both sides of said continuous casting so as to permit a workpiece to be cut off from said continuous casting at a length which substantially corresponds to a predetermined weight of a workpiece.

8. A continuous casting apparatus according to claim 1, wherein said multiple measuring device comprises a means for measuring the longitudinal speed of the continuous casting.

9. A continuous casting apparatus according to claim 1, wherein said multiple measuring device comprises a measuring roller having a pulse generator for measuring longitudinal movement of the continuous casting, a flame cutting machine measuring wheel with a pulse generator for cutting the continuous casting for measuring the distances covered by the flame cutting machine, and an associated weighing means for precisely determining the weight of portions cut from said continuous casting by said flame cutting machine while said casting is in motion or is briefly stationary.

10. A continuous casting apparatus according to claim 9, wherein said measuring roller is positioned to a stationary location at said track or at means for supporting said track, for the purpose of measuring the length of said continuous casting, and wherein said measuring roller comprises a pivotal mounting which is horizontally displaceable transversely with respect to the axis of said continuous casting for twin or triple castings, so as to permit upward or downward pivotal movement of a hollow measuring shaft carrying a measuring wheel thereon, abuttable on the surface of said continuous casting.

11. A continuous casting apparatus according to claim 1, comprising a weighing means associated with said flame cutting machine or said multiple measuring device, said weighing means transmitting the weighing measurement data for controlling the flame cutting machine.

12. A continuous casting apparatus according to claim 11, wherein said weighing means comprises a plurality of weighing rollers whose number depends upon the length of said continuous casting, said weighing rollers being located so as to be raiseable or lower-able on a pressure measuring means in a discharge roller bed subsequent to said flame cutting machine, and wherein said weighing means lifts a portion of said continuous casting which has just been cut off on the basis of the position of said portion.

13. A continuous casting apparatus according to claim 12, wherein said weighing means is of minimum weight and comprises one or two pressure measuring means which effect both a taring weighing operation and a gross weighing operation.

14. A continuous casting apparatus according to claim 12, wherein said weighing means comprises a plurality of cooperating weighing devices for short workpieces.

15. A continuous casting apparatus according to claim 11, wherein said weighing means for very long workpieces comprises a plurality of further weighing devices, wherein at least two weighing devices which are not disposed in juxtaposed relationship cooperate with one another.

16. A continuous casting apparatus according to claim 11, wherein said weighing means comprises previously existing components such as roller bed rollers for workpiece transportation, which are correspondingly subdivided and which cooperate in dependence upon length.

17. A continuous casting apparatus according to claim 11, wherein said weighing means feeds said data into an existing multiple measuring device or length measuring and control means of said flame cutting machine.

18. A continuous casting apparatus according to claim 11, wherein said weighing means comprises two or more supports for said workpiece which act in a substantially friction-free manner on a common force or weight measuring device, which determines the sum of all taring and gross weighing operations.

19. A continuous casting apparatus according to claim 18, wherein said support means of said weighing means comprise support struts or rollers in gaps in a workpiece transportation roller bed, which lift said workpiece for the weighing operation.

20. A continuous casting apparatus according to claim 19, wherein a measuring arm is provided for each support strut or roller at a location along said transportation roller bed, said measuring arm carrying said support means in the vicinity of a pivot point and bears at one end against a central weighing device.

21. A continuous casting apparatus according to claim 20, wherein a plurality of measuring arm portions are precisely located on levers on said measuring arm between a plurality of mountings, a support location and a connecting location to said central weighing device, and wherein the relationship between said measuring arm portions in respect of their length on the measuring arm levers is the same.

22. A continuous casting apparatus according to claim 20, wherein said central weighing device comprises a driven gyro device in a cardan-type suspension means, which converts the weighing lever contact force into rotary movement.

23. A continuous casting apparatus comprising: means for forming a continuous casting; a flame cutting machine for cutting off portions of said continuous casting; means for measuring data such as at least one of said width, thickness and cross-sectional shape of the cast portion, the casting temperature, the longitudinal speed of said casting, the homogeneity over the continuous length of said casting, surface defects of the casting, and the specific weight of the casting material; and computing and control means for evaluating said data for optimizing immediate and long term operation of said apparatus; and further wherein beneath a cylindrical or box-like machine body having three or four runner wheels is mounted a lever which can be raised or lowered by a pneumatic cylinder unit in said machine body, said lever carrying a plate at its front end and extending forwardly of said machine body, having a pressure member for abutting said cutting machine against said continuous casting for synchronization purposes.

24. A continuous casting apparatus according to claim 23, wherein disposed on said plate transversely with respect to said continuous casting is a track on which there are movably disposed a burner carriage having a water-cooled motor, a burner cantilever arm and a burner.

25. A continuous casting apparatus according to claim 24, comprising a heat protection plate secured to said plate beneath said burner track, said protection plate extending to a position below said machine body and having water flowing therethrough, and including a slot through which said burner cantilever arm extends.

26. A continuous casting apparatus according to claim 23, wherein suspended beneath said machine body is a parallelogram lever system whose main length is parallel to said machine body and which can be raised and lowered by said pneumatic cylinder unit in said machine body, and which on its forward end carries said plate and said pressure member.

27. A continuous casting apparatus comprising: means for forming a continuous casting; a flame cutting machine for cutting off portions of said continuous casting; means for measuring data such as at least one of the width, thickness and cross-sectional shape of the cast portion, the casting temperature, the longitudinal speed of said casting, the homogeneity over the continuous length of said casting, surface defects of the casting, and the specific weight of the material of said casting; and computing and control means for evaluating said data for optimizing immediate and long term operation of said apparatus; wherein said apparatus further comprises a frame made up of two projecting longitudinal and two transverse carriers each comprising hollow members, wherein said longitudinal members carry thereon runner and guide wheel mountings, said rearward transverse carrier carries thereon a railed platform adapted to be walked upon, and said front transverse carrier carries thereon two pivotal arms and a compressed air cylinder unit; and wherein said apparatus also comprises a water-cooled burner track secured to said pivotal arm in such a way as to be raised and lowered and which carries thereon at least one burner carriage and a pipe construction through which water flows, as a contact pressure member, and further carries a heat protection plate disposed beneath the burner track of an angular configuration to provide protection from radiant heat from below and from the front, said plate having a slot in its front portion, wherein a plurality of burner cantilever arms on said burner carriages extend through said slot and carry burners thereon.

28. A continuous casting apparatus according to claim 27, wherein disposed in front of said burner is a supply pipe for granulation or spray water, and which carries thereon an abutment-like alignment means for precise alignment of said burners relative to each other in order to produce cuts which are precisely aligned in one plane on said continuous casting.

29. A continuous casting apparatus according to claim 27, wherein said flame cutting machine is provided with a holding or braking means which applies a maximal frictional force for synchronization with said continuous casting shortly before reaching said burners, and which then, by virtue of release, provides for immediate slip-free entrainment to produce synchronous motion.

30. A continuous casting apparatus according to claim 27, wherein a stationary measuring means is disposed at said burner track or a support foundation means thereof, at a minimum spacing relative to said burners in the direction of longitudinal movement of said casting; said measuring means comprising a measuring wheel through which water flows, disposed on a hollow measuring shaft having a closed coolant system in the region of continuous casting, having a single-acting control cylinder for lowering said measuring wheel onto said continuous casting; and an associated pulse generator disposed in a protective position connected to an end of said hollow measuring shaft by way of a toothed belt drive.

31. A continuous casting apparatus according to claim 1, wherein said warning signals initiate replacement of a casting mold or said rolls during a subsequent repair operation.

32. A continuous casting apparatus according to claim 12, wherein said positional information is provided by a light barrier assembly.

33. A continuous casting apparatus according to claim 19, wherein said support struts or rollers are lifted by means of levers having an upward pivotal movement, moved by hydraulic stroke elements which in turn are moved by weighing means supported by said weighing arrangement.

34. A continuous casting apparatus according to claim 28, wherein said supply pipe is in the form of a square or rectangular pipe.

* * * * *

UNITED STATES PATENT AND TRADEMARK OFFICE

CERTIFICATE OF CORRECTION

PATENT NO. : 4,735,399

DATED : April 5, 1988

INVENTOR(S) : Horst K. Lotz

It is certified that error appears in the above-identified patent and that said Letters Patent is hereby corrected as shown below:

ON THE TITLE PAGE,

In [73] Assignee:, delete "Fed. Rep. of Germany" and insert --Switzerland--.

Signed and Sealed this

Third Day of January, 1989

*Attest:*

*Attesting Officer*

DONALD J. QUIGG

*Commissioner of Patents and Trademarks*